US010364609B2

(12) United States Patent
Deul et al.

(10) Patent No.: US 10,364,609 B2
(45) Date of Patent: Jul. 30, 2019

(54) METHOD FOR EXCAVATING MUD LINE CELLAR FOR SUBSEA WELL DRILLING

(71) Applicant: Noble Drilling Services Inc., Sugar Land, TX (US)

(72) Inventors: Hans H. J. Deul, Richmond, TX (US); Patrick O'Neill, Houston, TX (US); Matthew Sibrel, Missouri City, TX (US); Robert van Kuilenburg, Sugar Land, TX (US)

(73) Assignee: NOBLE DRILLING SERVICES INC., Sugar Land, TX (US)

( * ) Notice: Subject to any disclaimer, the term of this patent is extended or adjusted under 35 U.S.C. 154(b) by 0 days.

(21) Appl. No.: 15/921,615

(22) Filed: Mar. 14, 2018

(65) Prior Publication Data

US 2018/0274301 A1 Sep. 27, 2018

Related U.S. Application Data

(63) Continuation of application No. PCT/US2016/051920, filed on Sep. 15, 2016.
(Continued)

(51) Int. Cl.
*E21B 33/037* (2006.01)
*E21B 4/18* (2006.01)
(Continued)

(52) U.S. Cl.
CPC ..... *E21B 7/20* (2013.01); *E21B 4/18* (2013.01); *E21B 7/136* (2013.01); *E21B 33/037* (2013.01); *E21B 41/08* (2013.01)

(58) Field of Classification Search
CPC ..... E02F 7/28; E02D 23/08; E21B 41/0007; E21B 7/20; E21B 7/136; E21B 4/18; E21B 33/037; E21B 41/08
See application file for complete search history.

(56) References Cited

U.S. PATENT DOCUMENTS 3,063,500 A * 11/1962 Logan ..... E21B 33/037 166/351
3,461,957 A * 8/1969 West ..... E21B 33/037 166/351
(Continued)

FOREIGN PATENT DOCUMENTS

CA 1 179 254 A 12/1984
CA 1 194 410 A 10/1985
(Continued)

OTHER PUBLICATIONS

International Search Report and Written Opinion, International Application No. PCT/US16/51920.
(Continued)

*Primary Examiner* — Benjamin F Fiorello
(74) *Attorney, Agent, or Firm* — Richard A. Fagin

(57) ABSTRACT

A method for excavating a well cellar includes lowering an excavating apparatus having a cellar liner therein to a bottom of a body of water. The well cellar is excavated while contemporaneously lowering the cellar liner into the well cellar until a top of the cellar liner is substantially level with the bottom of the body of water. A pilot well is excavated below a bottom of the cellar. A well head support pipe is inserted into the pilot well. The bottom of the well cellar and a top of the cellar liner are covered.

11 Claims, 7 Drawing Sheets

Related U.S. Application Data

(60) Provisional application No. 62/218,600, filed on Sep. 15, 2015.

(51) Int. Cl.

| | |
|---|---|
| ***E21B 41/08*** | (2006.01) |
| ***E21B 7/20*** | (2006.01) |
| ***E21B 7/136*** | (2006.01) |

(56) References Cited

U.S. PATENT DOCUMENTS

| | | | | | |
|---|---|---|---|---|---|
| 3,592,263 | A | * | 7/1971 | Nelson | E21B 33/037 166/351 |
| 3,866,676 | A | * | 2/1975 | Burns | E21B 33/037 166/363 |
| 4,189,255 | A | | 2/1980 | Macan et al. | |
| 4,334,584 | A | | 6/1982 | Magill | |
| 4,335,740 | A | * | 6/1982 | Boley | E02D 29/12 137/364 |
| 4,558,744 | A | | 12/1985 | Gibb | |
| 4,624,318 | A | | 11/1986 | Aagaard et al. | |
| 4,730,677 | A | | 3/1988 | Pearce et al. | |
| 4,744,698 | A | | 5/1988 | Dallimer et al. | |
| 5,050,680 | A | * | 9/1991 | Diehl | E21B 33/037 137/312 |
| 5,310,286 | A | * | 5/1994 | Gilbert | E21B 33/037 166/356 |
| 8,967,273 | B2 | * | 3/2015 | Ray | E21B 47/1025 166/337 |
| 2003/0230409 | A1 | | 12/2003 | Guesnon et al. | |
| 2012/0298419 | A1 | | 11/2012 | Finkenzeller et al. | |
| 2015/0197907 | A1 | | 7/2015 | Aurora et al. | |

FOREIGN PATENT DOCUMENTS

| | | | |
|---|---|---|---|
| CA | 1 248 870 | A | 1/1989 |
| CA | 1248870 | A1 * | 1/1989 |
| WO | 2002063106 | A1 | 8/2002 |
| WO | 2015/118348 | A1 | 8/2015 |

OTHER PUBLICATIONS

Technical Examination Report with accompanying search opinion and search report; Danish Application No. PA 2018 70203.
Canadian Office Action; Application Serial No. 2,998,855.
Extended European Search Report—16847289.2-1002/3353368 PCT/US2016051920.

* cited by examiner

METHOD FOR EXCAVATING MUD LINE CELLAR FOR SUBSEA WELL DRILLING

CROSS REFERENCE TO RELATED APPLICATIONS

Continuation of International Application No. PCT/US2016/051920 filed on Sep. 15, 2016. Priority is claimed from U.S. Provisional Application No. 62/218,600 filed on Sep. 15, 2015. Both the foregoing applications are incorporated herein by reference in their entirety.

STATEMENT REGARDING FEDERALLY SPONSORED RESEARCH OR DEVELOPMENT

Not Applicable

NAMES OF THE PARTIES TO A JOINT RESEARCH AGREEMENT

Not Applicable.

BACKGROUND

This disclosure relates generally to the field of drilling wells below the bottom of a body of water. More specifically, the disclosure relates to methods for creating a cellar for placement of well pressure control equipment at a level below the water bottom.

Methods known in the art for placing well pressure control equipment or a wellhead proximate the bottom of a body of water may not provide for resistance to caving of water bottom sediments for a wellhead and/or pressure control equipment disposed below the water bottom. Excavation of the wellhead and/or pressure control equipment for subsequent operations on such a well may require the use of a mobile offshore drilling unit, and thus may be costly and inefficient.

DETAILED DESCRIPTION

Figure 1:
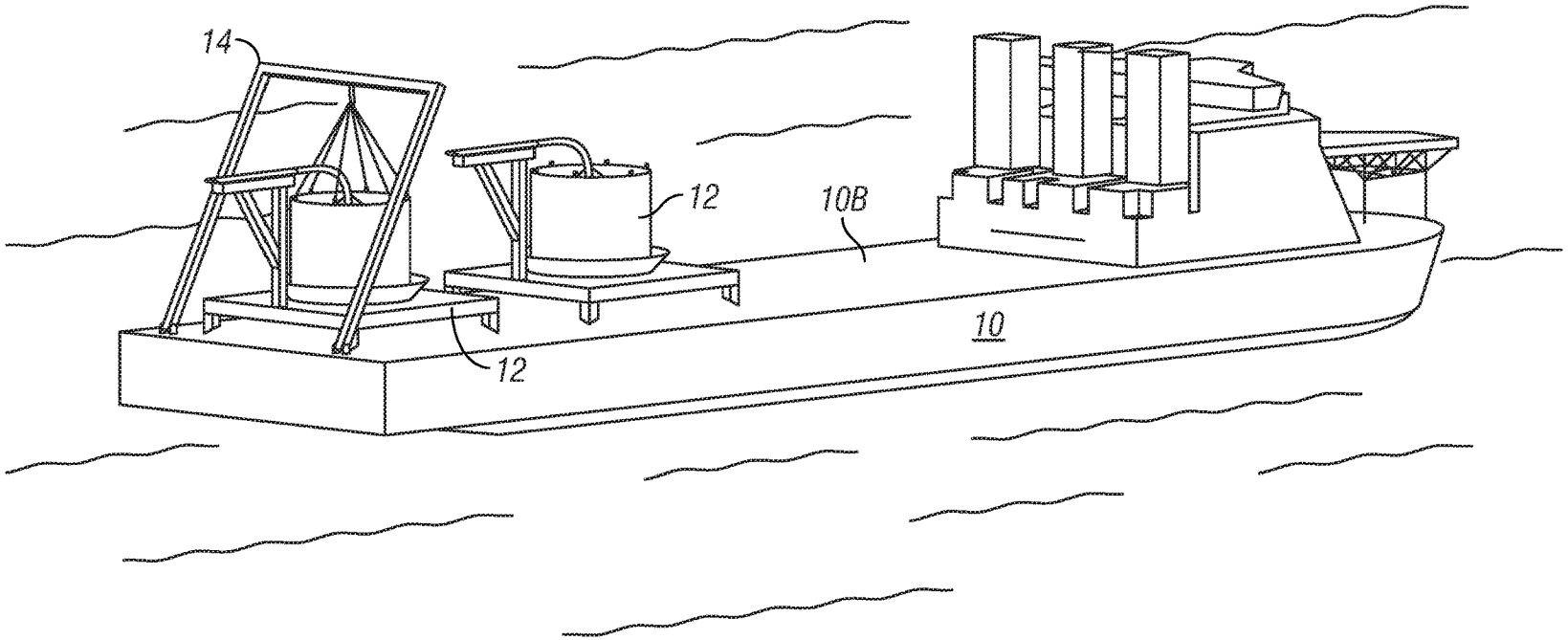
FIG. 1 shows a transport vessel moving a plurality of cellar excavation apparatus.

FIG. 1 shows a large dynamically positioned transport vessel 10 with a 150 ton capacity A-frame 14 and a plurality of mud line cellar excavation apparatus 13 on the deck 10B of the supply vessel 10.

Figure 2:
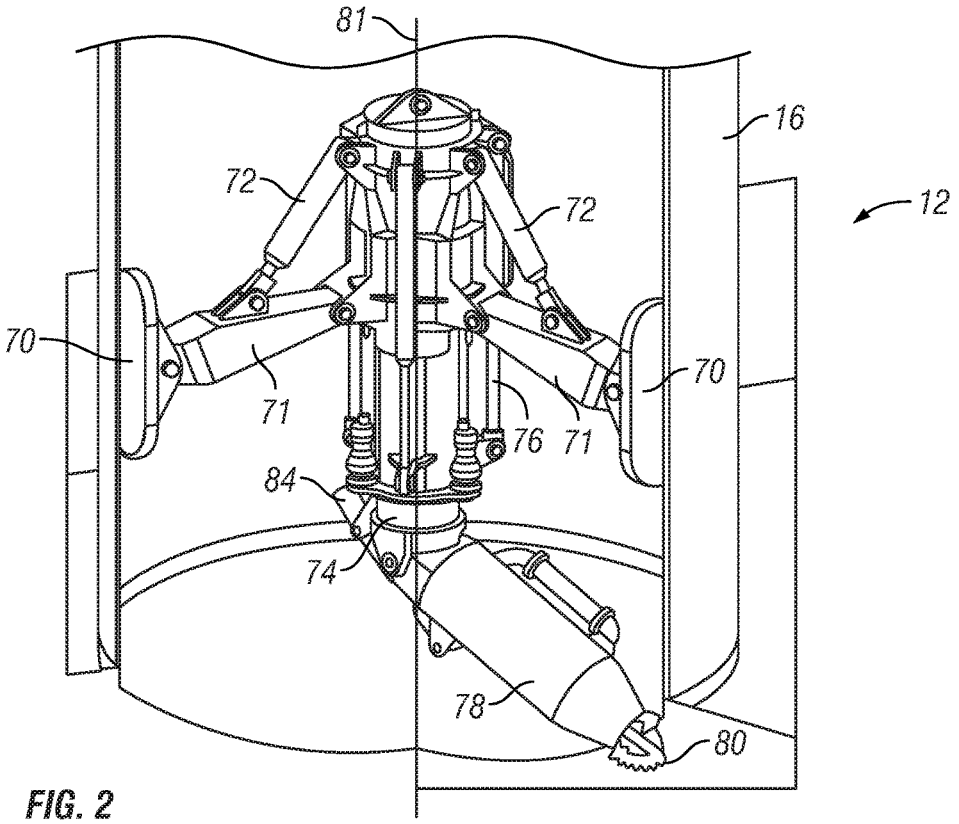
FIG. 2 shows an example embodiment of a cellar excavation apparatus.

FIG. 2 shows an example mudline cellar excavation apparatus 12 in more detail. The excavation apparatus 12 may be held in place inside a cellar liner 16 (explained below in more detail with reference to FIGS. 4 and 5) using pads 70 mounted to articulated arms 71. The arms 71 may be extended and retracted, e.g., by operating a mechanism such as an hydraulic cylinder 72 associated with each arm 71. The arms 71 when extended lock the excavation apparatus 12 in place inside the cellar liner 16. A first motor 78, e.g., a fluid operated motor or an electric motor may rotate a drill bit 80. The first motor 78 may be mounted to the excavation apparatus 12 using a pivoting element 74 operable, e.g., by a first hydraulic cylinder 82 so that the angle of the first motor 78 with respect to the longitudinal axis 81 of the excavation apparatus 12 may be controlled during use. A second hydraulic cylinder 76 may provide the apparatus 12 with the capability to move upwardly and downwardly. A second motor 82, e.g., an hydraulic or electric motor, may also be attached to the apparatus 12 so that it may rotate about the longitudinal axis 81. Such motion of the motors 78, 82 and the hydraulic cylinders 76, 82 may enable the drill bit 80 to traverse any selected drilling pattern. Rotation of the drill bit 80 by the first motor 78 may enable removing the sediments inside the cellar liner 16 so as to excavate the cellar (see FIG. 5). The first motor 78 or another motor may also operate a pump (not shown) to lift drill cuttings and sediment from the cellar (FIG. 5) as excavation proceeds such that the cuttings and sediment may be discharged through a line (see FIG. 5). Motive fluid or other source of power (e.g., electric power) to operate the excavation apparatus 12 may be provided by an umbilical line (not shown) extending from the vessel (10 in FIG. 1) to the excavation apparatus 12.

Figure 3:
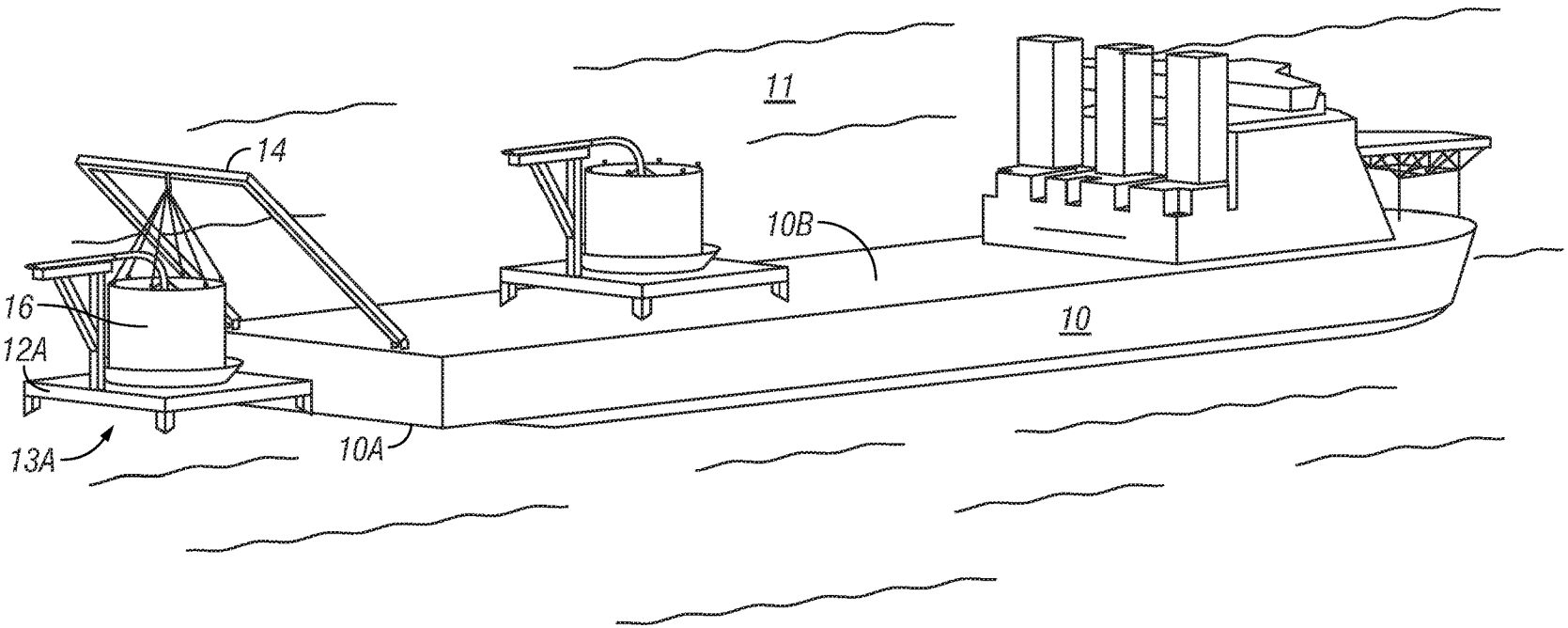
FIG. 3 shows the transport vessel beginning to lower one of the excavation apparatus.

FIG. 3 shows lowering a base frame 12A, mud line cellar liner 16 and excavating apparatus 12 over the aft end 10A of the transport vessel 10 into a body of water 11. As will be explained with reference to FIG. 4, the lowering continues until the excavation apparatus 12 rests on the water bottom (17 in FIG. 4).

Figure 4:
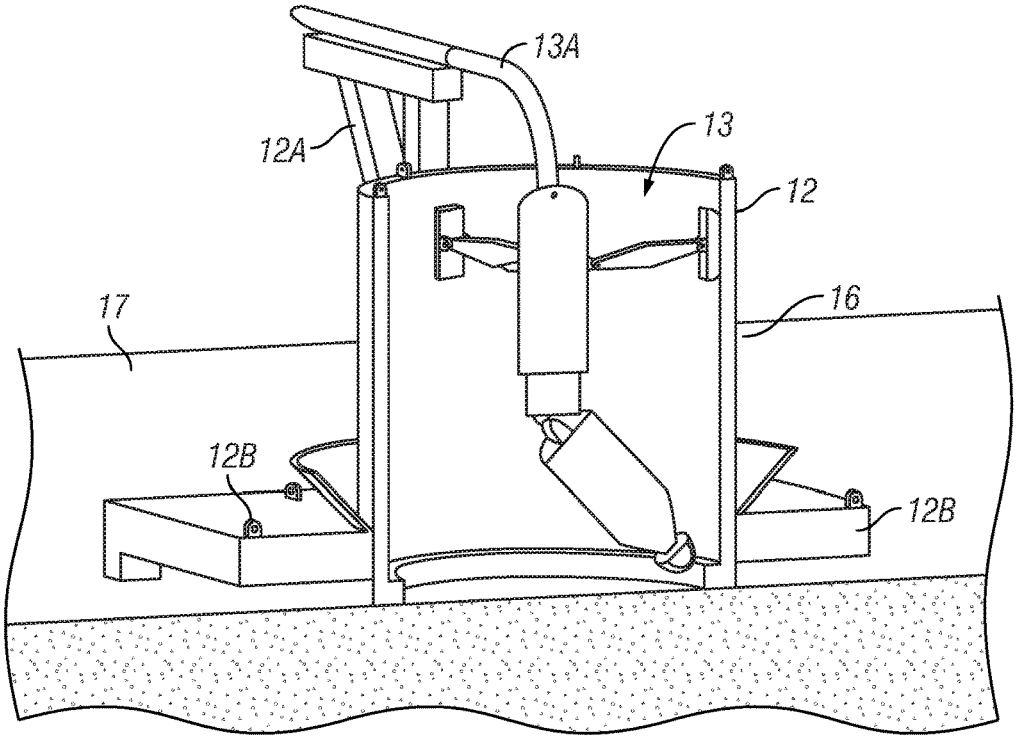
FIG. 4 shows the excavation apparatus on the water bottom.

FIG. 4 shows setting the base frame 12A, which may include torque arrestor legs 12B on the water bottom 17. Excavating the cellar (see 15 in FIG. 5) may then be started by operating the excavation apparatus 13 disposed inside the cellar liner 16. The cellar liner 16 may be made from cast concrete, steel or any other dense, high strength material and may have anti rotation slots (not shown) engaged with mating features in the base frame 12A. The cellar liner 16 will lower into the excavated cellar (15 in FIG. 5) corresponding to advancement in excavation of the cellar 15. Cuttings are discharged away from the cellar (15 in FIG. 5) as excavation proceeds through a discharge line 13A forming part of the umbilical (not shown).

Figure 5:
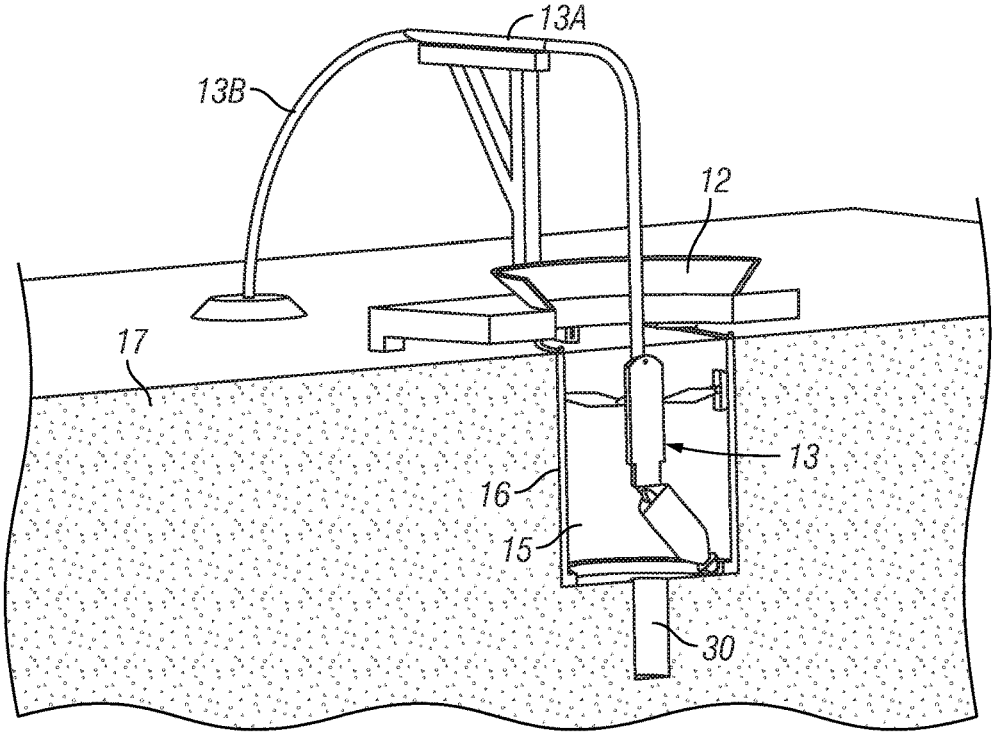
FIG. 5 shows the excavation apparatus creating a cellar while contemporaneously lining the cellar with a liner.

FIG. 5 shows excavation of the cellar 15 continuing until the top of the cellar liner 16 is at the level of the water bottom 17. Then a pilot well 30, which may be, for example, thirty inches in diameter, is excavated below the bottom of the cellar 15, such as by jetting or using the motor and bit (78 and 80, respectively in FIG. 2) operated vertically and beginning at the bottom of the cellar 15. Cuttings and other sediments may be pumped through the excavation apparatus 12 through the discharge line 13A and a hose 13B to dump the cuttings and sediment away from the cellar 15. After the pilot well 30 is drilled to a selected depth, the base frame 12A and excavating apparatus 13 may them be retrieved from the cellar 15 and withdrawn to the transport vessel (10 in FIG. 1).

Figure 6:
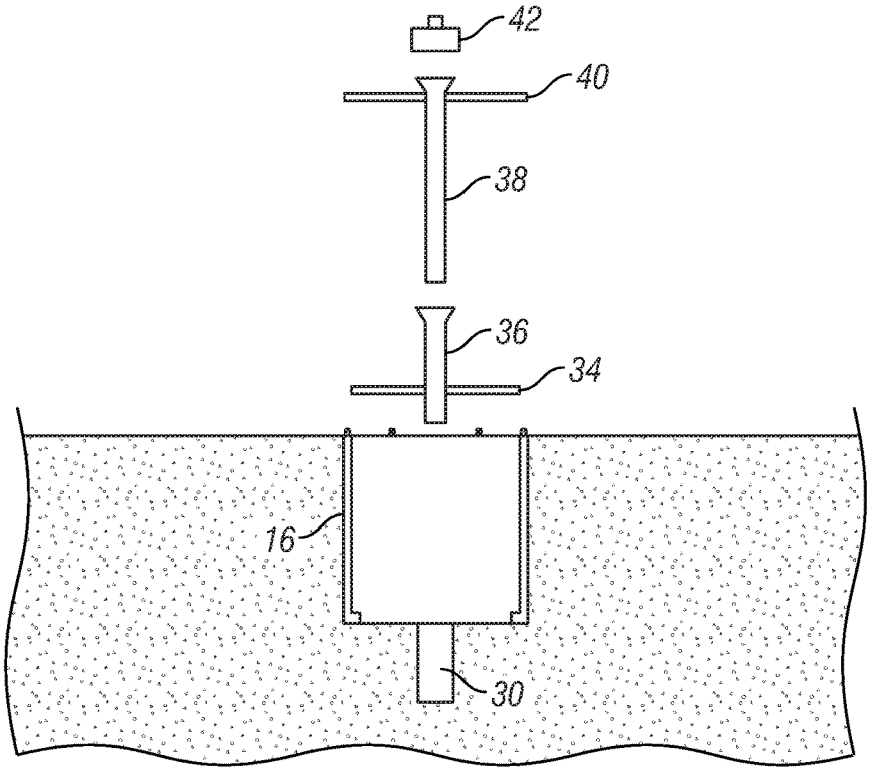
FIG. 6 shows installation of a cellar base and wellhead support casing.

In FIG. 6, a cellar base 34, a wellhead support casing 36, a temporary extension pipe 38 and a cellar top cover 40 may then be moved from the transport vessel (10 in FIG. 1) and lowered onto position in the interior of the concrete liner 16 such that the temporary extension pipe 38 and the wellhead support pipe 36 are disposed in the pilot well 30 and the cellar base 34 rests on the bottom of the cellar (15 in FIG. 5). The top cover 40 closes the upper end of the cellar liner 16 to keep it free from sediments and debris. A cap 42 with a locating beacon, e.g., an acoustic transponder, may be attached to the top of the extension pipe 38.

Figure 7:
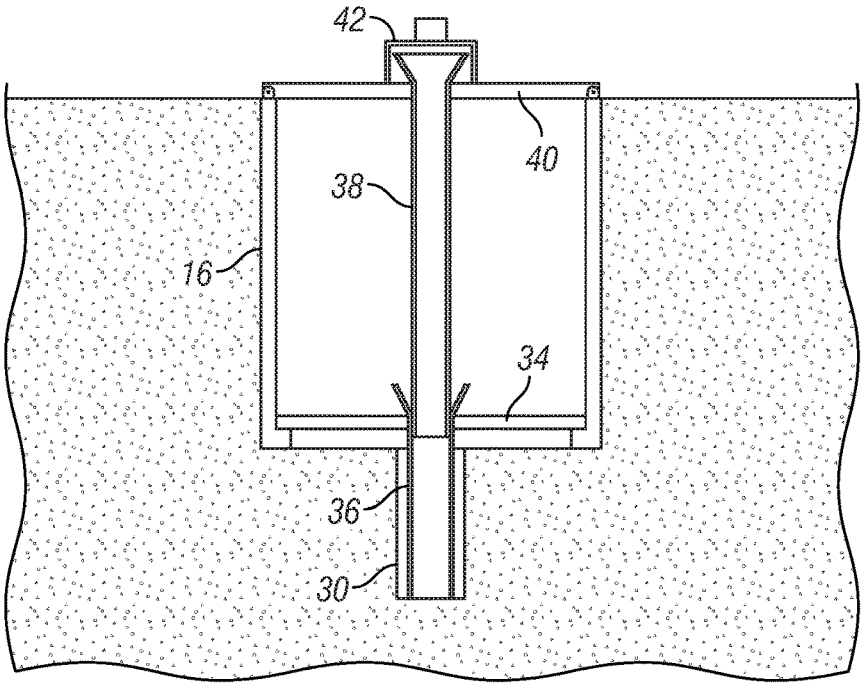
FIG. 7 shows temporary abandonment of the cellar and pilot well.

FIG. 7 shows the assembled cellar base 34, wellhead support pipe 36, extension pipe 38, cellar top cover 40 and cap 42 all in relation to the cellar liner 16 and the pilot hole 30. After the foregoing assembly is completed, the transport vessel (10 in FIG. 1) may then move from the cellar and pilot well location. The foregoing cellar excavation operation may then be repeated at one or more additional well locations.

Figure 8:
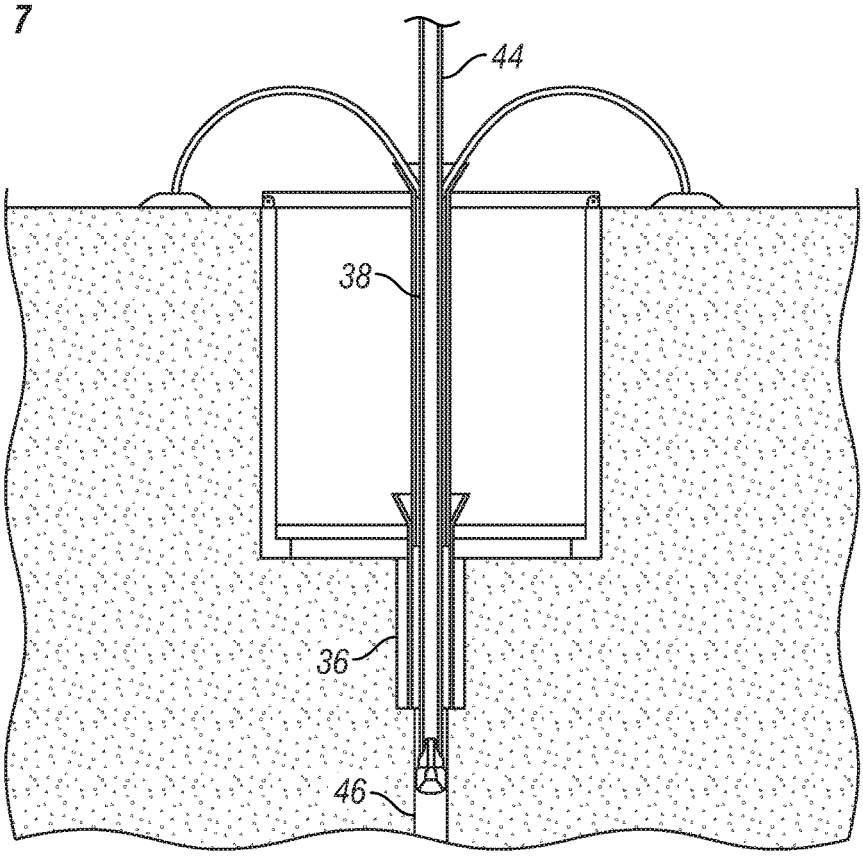
FIG. 8 shows re-entry into the pilot well and drilling a "surface" well for insertion of surface casing.

FIG. 8 shows operations performed after a well drilling unit, for example and without limitation a mobile offshore drilling unit such as a drill ship, a semisubmersible rig and a jackup or other bottom supported drilling unit, is moved to the location of the excavated cellar 15. The cap and beacon (42 in FIG. 7) may be retrieved from the top of the temporary pipe 36. A well drilling assembly 44 that may fit within the temporary pipe 38, for example a 26 inch diameter well drilling assembly, is lowered into the temporary pipe 38 and a surface well 46 is drilled to a required depth.

Figure 9:
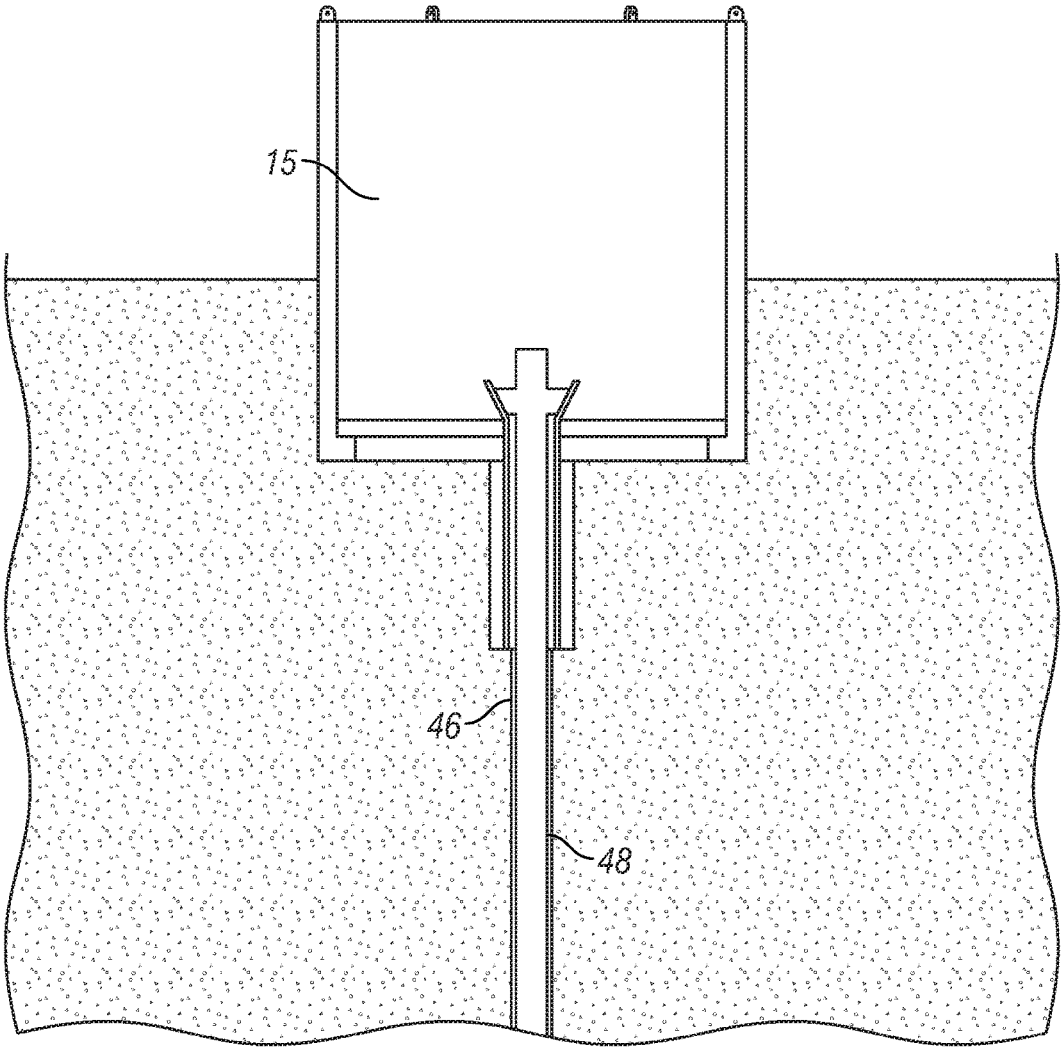
FIG. 9 shows completion of the surface well.

FIG. 9 shows the drilling assembly (44 in FIG. 8) and the extension pipe (38 in FIG. 8) removed from the surface well 46. The top plate (40 in FIG. 7) and the extension pipe (38 in FIG. 8) may be removed from the cellar 15. A surface casing 48 with a wellhead (not shown) may be inserted into the surface well 46 and cemented in place.

Figure 10:
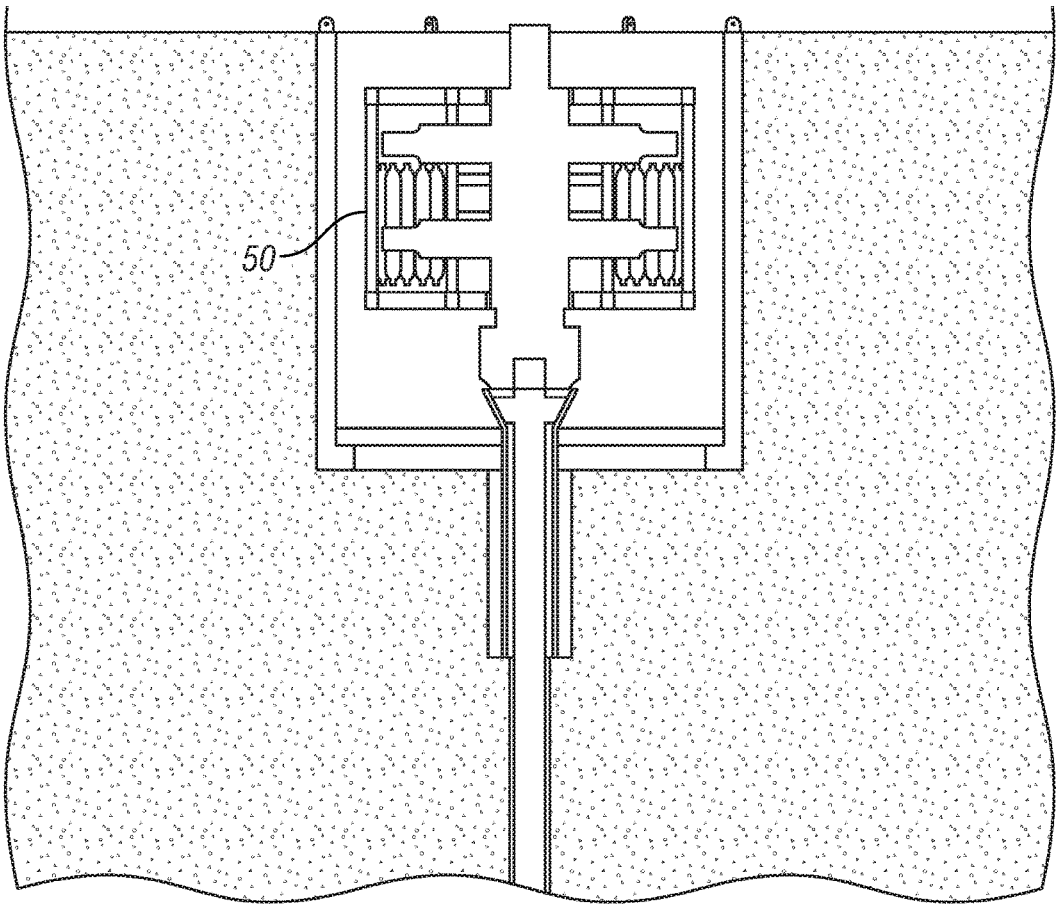
FIG. 10 shows attachment of well pressure control apparatus to the casing head of the surface well.

FIG. 10 shows attaching a well pressure control apparatus 50, i.e., a blowout preventer (BOP) system to the surface casing 48. After the BOP 50 is attached, well drilling operations may continue to a selected objective formation below the water bottom (17 in FIG. 3).

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A method for excavating a well cellar, comprising:

lowering an excavating apparatus having a cellar liner therein to a bottom of a body of water, the excavating apparatus comprising pads mounted to articulated arms, the arms extendable and retractable to selectively lock the excavating apparatus in place inside the cellar liner, a first motor coupled to a drill bit, the first motor mounted to the excavating apparatus by a pivoting element operable so that an angle of the first motor with respect to a longitudinal axis of the excavating apparatus is controllable during use, means to move the excavating apparatus upwardly and downwardly, and a second motor attached to excavating apparatus enable rotation of the first motor about the longitudinal axis;

excavating the well cellar by operating the excavating apparatus, while contemporaneously lowering the cellar liner into the well cellar until a top of the cellar liner is substantially level with the bottom of the body of water;

excavating a pilot well below a bottom of the cellar using the excavating apparatus; and inserting a well head support pipe into the pilot well.

2. The method of claim 1 further comprising inserting an extension pipe into the wellhead support pipe, the extension pipe extending through a cover on the top of the cellar liner.

3. The method of claim 2 further comprising covering the extension pipe with a cap having a locating beacon affixed thereto.

4. The method of claim 3 further comprising:

removing the cap;

drilling a surface well to a selected depth;

removing the extension pipe; and inserting a surface casing in the surface well to the selected depth and cementing the surface casing in the surface well.

5. The method of claim 4 further comprising removing the cover from the top of the cellar liner and affixing a well pressure control apparatus to an upper end of the surface casing.

6. The method of claim 4 wherein the removing the cap, drilling the surface well, removing the extension pipe and inserting and cementing the surface casing is performed from a drilling unit moved to a location of the well cellar.

7. The method of claim 1 wherein the cellar liner comprises concrete.

8. The method of claim 1 wherein the excavating apparatus and cellar liner are lowered to the bottom of the body of water from a transport vessel.

9. The method of claim 8 further comprising moving the transport vessel from a location of the well cellar after covering the bottom of the well cellar and the top of the cellar liner.

10. The method of claim 9 further comprising moving the transport vessel to a location different than the location of the well cellar and repeating the lowering an excavating apparatus having a cellar liner therein to a bottom of a body of water, excavating the well cellar while contemporaneously lowering the cellar liner into the well cellar until a top of the cellar liner is substantially level with the bottom of the body of water, excavating a pilot well below a bottom of the cellar, inserting a well head support pipe into the pilot well and covering the bottom of the well cellar and a top of the cellar liner at the different location.

11. The method of claim 1 further comprising covering the bottom of the well cellar and a top of the cellar liner.

* * * * *